US007781694B2

(12) United States Patent
Stoving

(10) Patent No.: US 7,781,694 B2
(45) Date of Patent: Aug. 24, 2010

(54) VACUUM FAULT INTERRUPTER

(75) Inventor: Paul N. Stoving, Oak Creek, WI (US)

(73) Assignee: Cooper Technologies Company, Houston, TX (US)

( * ) Notice: Subject to any disclaimer, the term of this patent is extended or adjusted under 35 U.S.C. 154(b) by 367 days.

(21) Appl. No.: 11/758,136

(22) Filed: Jun. 5, 2007

(65) Prior Publication Data

US 2008/0302763 A1 Dec. 11, 2008

(51) Int. Cl.
*H01H 33/66* (2006.01)

(52) U.S. Cl. ..... 218/136; 218/118

(58) Field of Classification Search ..... 218/10, 218/118–130, 134–137, 139, 140, 147
See application file for complete search history.

(56) References Cited

U.S. PATENT DOCUMENTS 3,372,259 A 3/1968 Porter
3,469,050 A 9/1969 Robinson et al.
3,471,669 A 10/1969 Curtis
3,740,511 A 6/1973 Westmoreland
4,032,737 A 6/1977 Huhse et al.
4,071,727 A 1/1978 Crouch et al.
4,135,071 A * 1/1979 Crouch ..... 200/275
4,532,391 A 7/1985 Bernt
4,568,804 A 2/1986 Luehring
4,596,945 A 6/1986 Schumacher et al.
4,704,506 A 11/1987 Kurosawa et al.
4,839,481 A 6/1989 Nash et al.
4,871,888 A 10/1989 Bestel
4,982,059 A 1/1991 Bestel
5,004,877 A 4/1991 Yin
5,099,093 A 3/1992 Schels et al.
5,175,403 A 12/1992 Hamm et al.
5,252,913 A 10/1993 Falkowski et al.
5,612,523 A 3/1997 Hakamata
5,667,060 A 9/1997 Luzzi
5,717,185 A 2/1998 Smith
5,736,705 A 4/1998 Bestel et al.
5,747,765 A 5/1998 Bestel et al.
5,747,766 A 5/1998 Waino et al.
5,777,287 A 7/1998 Mayo
5,793,008 A 8/1998 Mayo et al.
5,804,788 A 9/1998 Smith
5,808,258 A 9/1998 Luzzi
5,861,597 A 1/1999 Bolongeat-Mobleu et al.
5,864,942 A 2/1999 Luzzi
5,912,604 A 6/1999 Harvey et al.
5,917,167 A 6/1999 Bestel
6,130,394 A 10/2000 Hogl (Continued)

FOREIGN PATENT DOCUMENTS

DE 19906972 2/1999

(Continued)

OTHER PUBLICATIONS

U.S. Appl. No. 11/881,952, Stoving.

(Continued)

*Primary Examiner*—Renee S Luebke
*Assistant Examiner*—Marina Fishman
(74) *Attorney, Agent, or Firm*—King & Spalding LLP

(57) ABSTRACT

Exemplary vacuum fault interrupters are described.

28 Claims, 10 Drawing Sheets

U.S. PATENT DOCUMENTS

| | | | |
|---|---|---|---|
| 6,163,002 | A | 12/2000 | Ahn et al. |
| 6,248,969 | B1 | 6/2001 | Komuro et al. |
| 6,362,445 | B1 | 3/2002 | Marchand |
| 6,376,791 | B1 | 4/2002 | Watanabe et al. |
| 6,479,779 | B1 | 11/2002 | Falkingham et al. |
| 6,506,992 | B2 | 1/2003 | Kim |
| 6,686,552 | B2 | 2/2004 | Nishijima et al. |
| 7,278,889 | B2 | 6/2004 | Muench et al. |
| 6,867,385 | B2 | 3/2005 | Stoving et al. |
| 6,965,089 | B2 | 11/2005 | Stoving et al. |
| 7,173,208 | B2 | 2/2007 | Harada et al. |
| 2002/0043514 | A1 | 4/2002 | Kim |
| 2002/0144977 | A1 | 10/2002 | Kikuchi et al. |
| 2004/0121657 | A1 | 6/2004 | Muench et al. |
| 2004/0164051 | A1 | 8/2004 | Stoving et al. |
| 2004/0242034 | A1 | 12/2004 | Rinehart et al. |
| 2007/0108164 | A1 | 5/2007 | Muench et al. |
| 2007/0241080 | A1 | 10/2007 | Stoving et al. |

FOREIGN PATENT DOCUMENTS

| | | |
|---|---|---|
| EP | 0782162 | 7/1997 |
| WO | WO 00/41199 | 7/2000 |

OTHER PUBLICATIONS

U.S. Appl. No. 11/881,952, Stoving et al.
U.S. Appl. No. 11/673,759, Stoving et al.
U.S. Appl. No. 11/758,136, Stoving et al.
Greenwood, Allan; Vacuum Switchgear, The Institution of Electrical Engineers; London. United Kingdom; 1994, pp. 109, 124-126.

* cited by examiner

VACUUM FAULT INTERRUPTER

BACKGROUND

This description relates to vacuum fault interrupters, such as axial magnetic field vacuum fault interrupters.

DETAILED DESCRIPTION

The following description of exemplary embodiments refers to the attached drawings, in which like numerals indicate like elements throughout the several figures.

Figure 1:
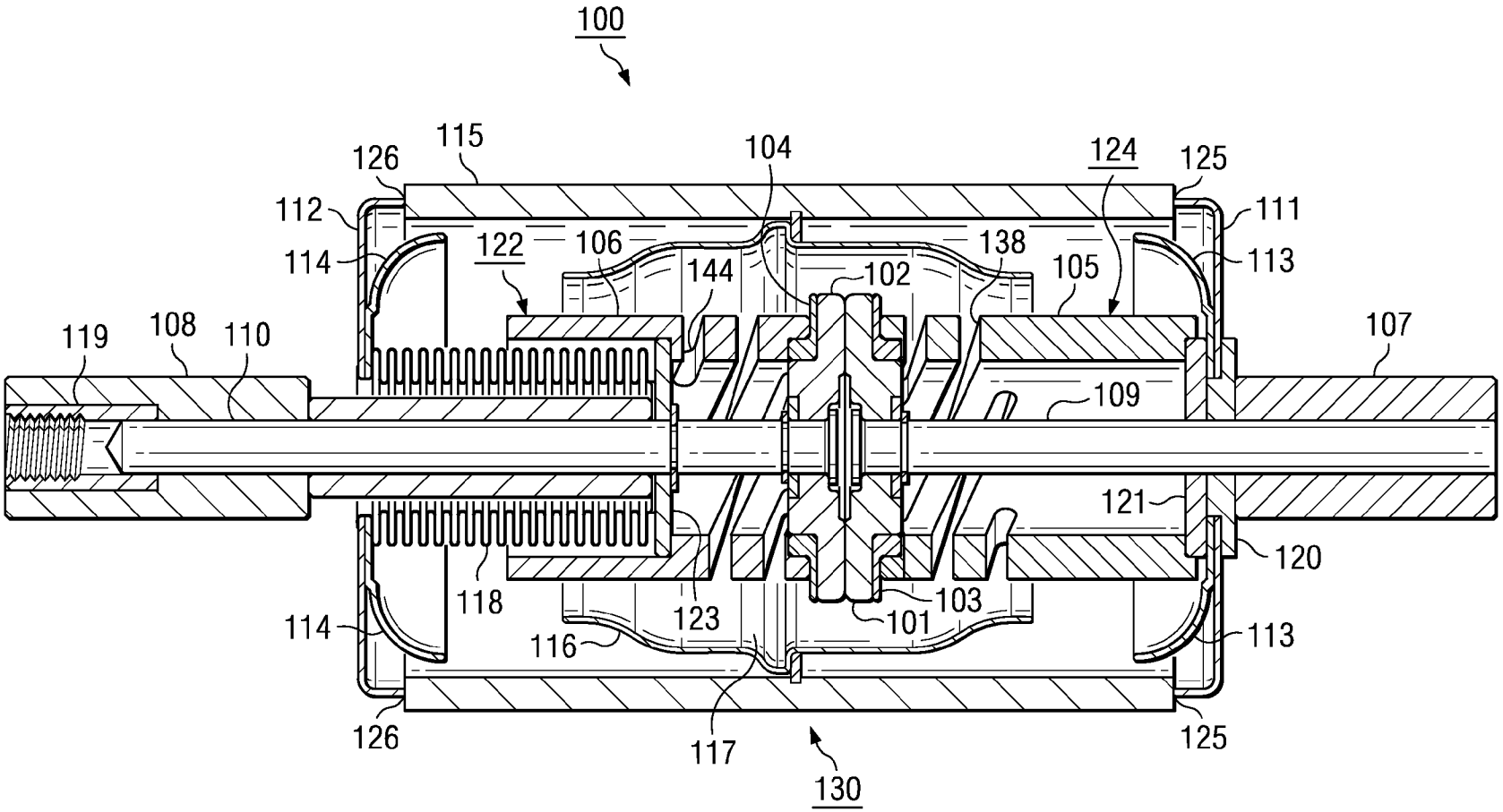
FIG. 1 is a cross-sectional side view of an exemplary vacuum fault interrupter, in a closed position.
Figure 2:
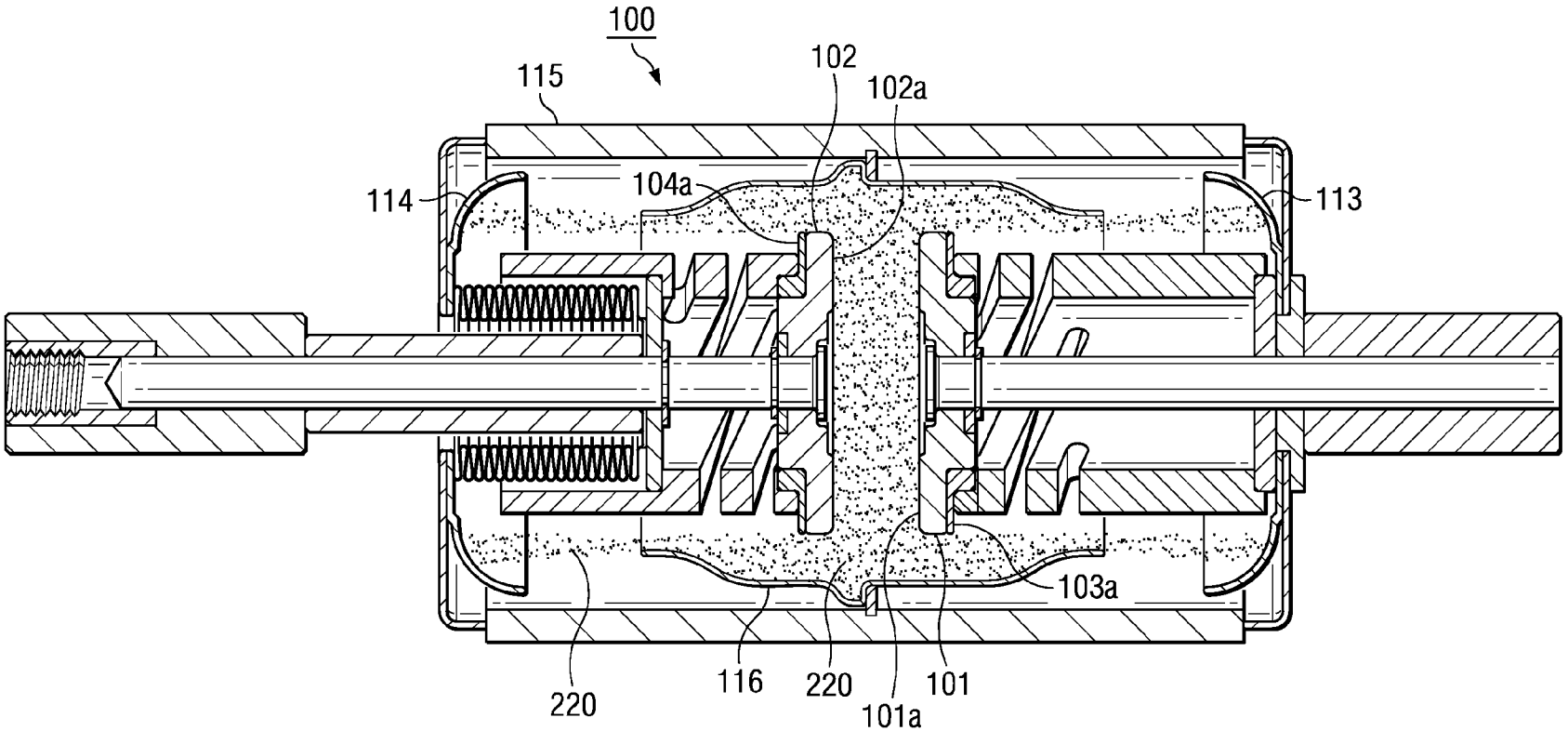
FIG. 2 is a cross-sectional side view of the exemplary vacuum fault interrupter of FIG. 1, in an open position.

FIGS. 1 and 2 are cross-sectional side views of an exemplary vacuum fault interrupter 100. The vacuum fault interrupter 100 includes a vacuum vessel 130 designed to maintain an integrity of a vacuum seal with respect to components enclosed therein. Air is removed from the vacuum vessel 130, leaving a deep vacuum 117, which has a high voltage withstand and desirable current interruption abilities. The vacuum vessel 130 includes an insulator 115 comprising a ceramic material and having a generally cylindrical shape. For example, the ceramic material can comprise an aluminous material such as aluminum oxide. A movable electrode structure 122 within the vessel 130 is operable to move toward and away from a stationary electrode structure 124, thereby to permit or prevent a current flow through the vacuum fault interrupter 100. A bellows 118 within the vacuum vessel 130 includes a convoluted, flexible material configured to maintain the integrity of the vacuum vessel 130 during a movement of the movable electrode structure 122 toward or away from the stationary electrode structure 124. The movement of the movable electrode structure 122 toward or away from the stationary electrode structure 124 is discussed in more detail below.

The stationary electrode structure 124 includes an electrical contact 101 and a tubular coil conductor 105 in which slits 138 are machined. The electrical contact 101 and the tubular coil conductor 105 are mechanically strengthened by a structural support rod 109. For example, the tubular coil conductor 105 can include one or more pieces of copper or other suitable material, and the structural support rod 109 can include one or more pieces of stainless steel or other suitable material. An external conductive rod 107 is attached to the structural support rod 109 and to conductor discs 120 and 121. For example, the conductive rod 107 can include one or more pieces of copper or other suitable material. Either the structural support rod 109 or the conductive rod 107 may include one or more threads to facilitate the electrical or mechanical connections necessary to conduct current through the vacuum fault interrupter 100 or to open or close the vacuum fault interrupter 100.

The movable electrode structure 122 includes an electrical contact 102, a conductor disc 123, and a tubular coil conductor 106 in which slits 144 are machined. For example, the tubular coil conductor 106 can include one or more pieces of copper or other suitable material. The conductor disc 123 is attached to the bellows 118 and the tubular coil conductor 106 such that the electrical contact 102 can be moved into and out of contact with the electrical contact 101 of the stationary electrode structure 124. Each of the electrical contacts 101 and 102 can include copper, chromium, and/or other suitable material. For example, each of the contacts 101 and 102 can include a composition comprising 70% copper and 30% chromium or a composition comprising 35% copper and 65% chromium.

The movable electrode structure 122 is mechanically strengthened by a structural support rod 110, which extends out of the vacuum vessel 130 and is attached to a moving rod 108. For example, the structural support rod 110 can include one or more pieces of stainless steel or other suitable material, and the moving rod 108 can include one or more pieces of copper or other suitable material. The moving rod 108 and the support rod 110 serve as a conductive external connection point between the vacuum fault interrupter 100 and an external circuit (not shown), as well as a mechanical connection point for actuation of the vacuum fault interrupter. Either the structural support rod 110 or the conductive rod 108 can include one or more threads, such as threads 119, to facilitate the electrical or mechanical connections necessary to conduct current through the vacuum fault interrupter 100 or to open or close the vacuum fault interrupter 100.

A vacuum seal at each end of the insulator 115 is provided by metal end caps 111 and 112, which are brazed to a metalized surface on the insulator 115, at joints 125-126. Along with end cap 111, an end shield 113 protects the integrity of the vacuum fault interrupter 100. Both the end cap 111 and the end shield 113 are attached between conductor discs 120 and 121. Similarly, an end shield 114 is positioned between the bellows 118 and end cap 112.

When the vacuum fault interrupter 100 is in a closed position, as illustrated in FIG. 1, current can flow, for example, from the tubular coil conductor 105 of the stationary electrode structure 124, the electrical contact 101 of the stationary electrode structure 124, and the electrical contact 102 of the movable electrode structure 122 to the tubular coil conductor 106 of the movable electrode structure 122, so that, with respect to contacts 101 and 102, the current can flow straight through from the ends of slits 138 and 144 in tubular coil conductor 105 and tubular coil conductor 106, respectively. The slits 138 in tubular coil conductor 105 are configured to force the current to follow a substantially circumferential path before entering the electrical contact 101. Likewise, the slits 144 in tubular coil conductor 106 are configured to force the current that exits from the electrical contact 102 to follow a substantially circumferential path before exiting the vacuum fault interrupter 100 via moving rod 108. A person of ordinary skill in the art, having the benefit of the present disclosure, will recognize that the current flow can be reversed.

A contact backing 103 is disposed between the electrical contact 101 and the tubular coil conductor 105 of the stationary electrode structure 124. Similarly, a contact backing 104 is disposed between the electrical contact 102 and the tubular coil conductor 106 of the movable electrode structure 122. Each of the contact backings 103 and 104 can comprise one or more pieces of copper, stainless steel, and/or other suitable material. The contact backings 103 and 104 and the slits 138 and 144 of the tubular coil conductors 105 and 106 can be used to generate a magnetic field parallel to the common longitudinal axis of the electrode structures 122 and 124, the electrical contacts 101 and 102, and the insulator 115 (hereinafter, an "axial magnetic field").

When the vacuum fault interrupter 100 is in an open position, in other words, when the electrical contacts 101 and 102 are separated, as illustrated in FIG. 2, the electrical contacts 101 and 102 will arc until the next time the current is substantially zero (hereinafter, "crosses zero" or "current zero"). Typically, a 60 Hz AC current crosses zero 120 times per second. The axial magnetic field generated by the contact backings 103 and 104 and the slits 138 and 144 of the tubular coil conductors 105 and 106 can control the electrical arcing between the electrical contacts 101 and 102. For example, the axial magnetic field can cause a diffuse arc between the electrical contacts 101 and 102.

The arc consists of metal vapor, commonly called a "plasma," that is boiled off of the surface of each electrical contact 101, 102. Most of the metal vapor from each electrical contact 101, 102 deposits on the other electrical contact 101, 102. The remaining vapor disperses within the vacuum vessel 130. The primary region that can be filled with the arc plasma is easily calculable based on line of sight from the contacts 101 and 102, and is shown as item 220 in FIG. 2. A secondary region of the arc plasma, which can be identified based on reflection and bouncing of the arc plasma, can be small and will not be described in detail herein.

A centrally disposed metallic shield 116 is configured to contain the conductive arc plasma 220 and to prevent it from depositing on the surface of the insulator 115. Similarly, end shields 113 and 114 are configured to contain the conductive arc plasma 220 that passes by the ends of the center shield 116. The end shields 113 and 114 can prevent the arc plasma 220 from depositing on the certain surfaces of the insulator 115 and can protect the joints 125-126 at the ends of the insulator 115 from high electrical stress (electric field). Each of the shields 113, 114, 116 can include one or more pieces of copper, stainless steel, and/or other suitable material.

Depending on the characteristics of the power system associated with the vacuum fault interrupter 100, a substantial voltage (in other words, a transient recovery voltage or "TRV")—well in excess of the nominal voltage of the power system—may appear briefly after the arc has cleared. For example, for a 38 kV power system, the TRV can have a peak of up to 71.7 kV or even 95.2 kV. This voltage can appear in a very short time, on the order of 20 to 70 microseconds. The vacuum fault interrupter 100 can be configured to withstand these and other transient voltages far in excess of the system voltage. For example, for a 38 kV device, the interrupter 100 can be configured to withstand, or maintain an open circuit, at voltage values of 70 kV AC rms, or 150 kV or 170 kV peak basic impulse level ("BIL"). By way of example only, these voltages can result from switching components in or out of the power system or lightning strikes to the power system.

The corners on the faces 101*a* and 102*a* of electrical contacts 101 and 102, respectively, and on the backsides 103*a* and 104*a* of contact backings 103 and 104, respectively, as well as the tips of end shields 113 and 114 and center shield 116, represent sharp corners and edges that can cause a high electrical stress (electric field). A person of ordinary skill, having the benefit of the present disclosure, will recognize that electrical stress can be varied by three major factors: voltage, distance, and size. For example, the electrical stress between two contacts is higher where the voltage difference between the contacts is higher. The electrical stress between two contacts is lower where the contacts are spaced further apart. Similarly, the size (i.e., dimensions and shape) of an object can affect electrical stress. In general, an object with features having small convex dimensions and sharp radii will have high electrical stress. An excessively high electric field can lead to failures of an object or other medium to withstand voltage.

The high temperature of the metal vapor also can lower the ability of the vacuum fault interrupter 100 to withstand high voltages. For example, if the hot arc plasma 220 passes in close proximity to the tip of one of the shields 113, 114, and 116, the shield 113, 114, or 116 can become too hot to withstand a desired amount of voltage. The heat and electrical stress applied to the contacts 101 and 102 and the tips of the shields 113, 114, and 116 could cause the contacts 101 and 102 or the tips of the shields 113, 114, and 116 to discharge additional arc plasma. Such arcing can lead to metal vapor depositing on the inside surface of the insulator 115, leading to a degradation of the voltage withstand ability of the vacuum fault interrupter 100. The vapor can deposit on the inside surface of the insulator 115, even if that surface is not in the direct line of sight of the contacts 101 and 102.

Figure 3:
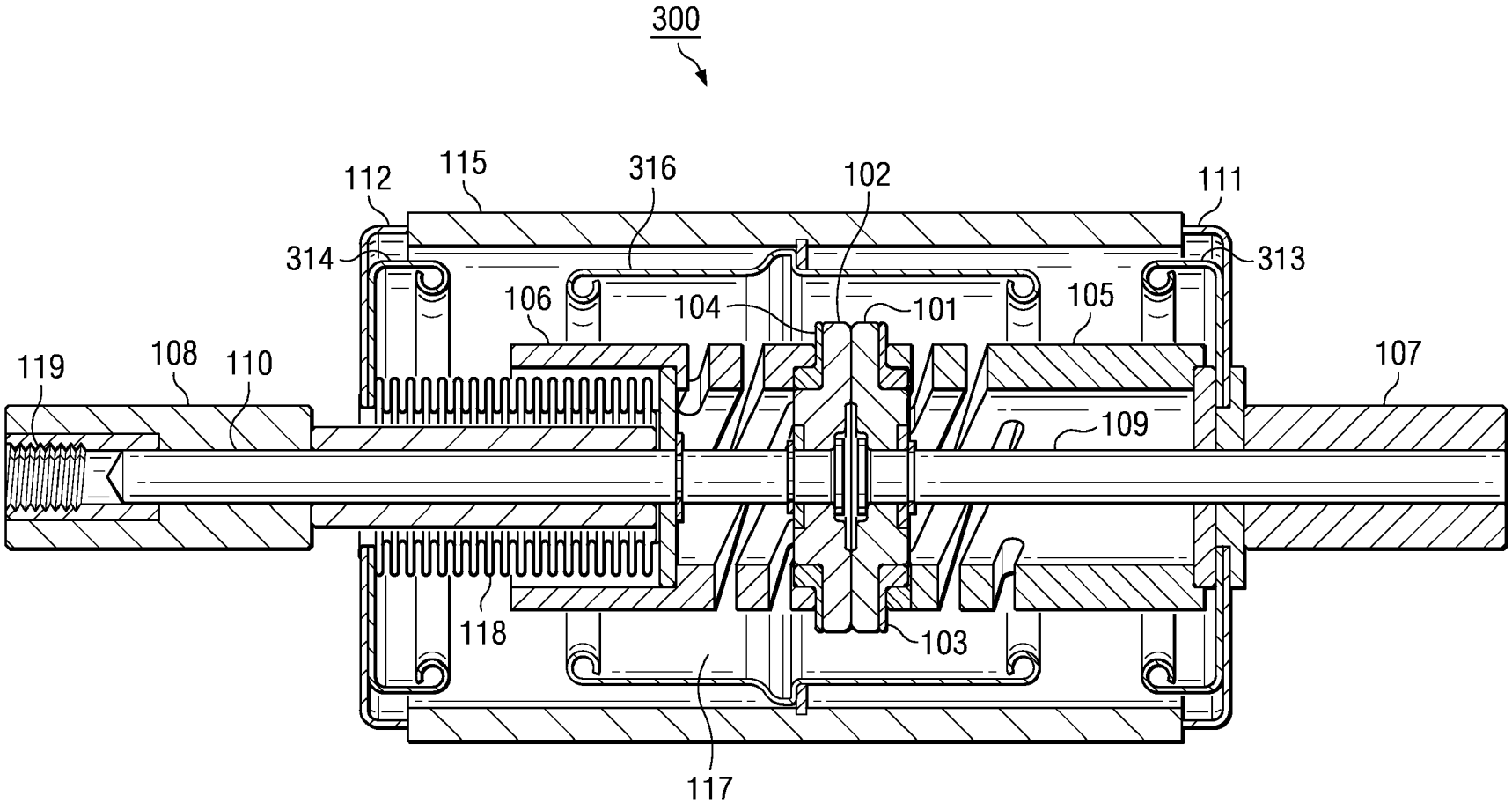
FIG. 3 is a cross-sectional side view of another exemplary vacuum fault interrupter, in a closed position.
Figure 4:
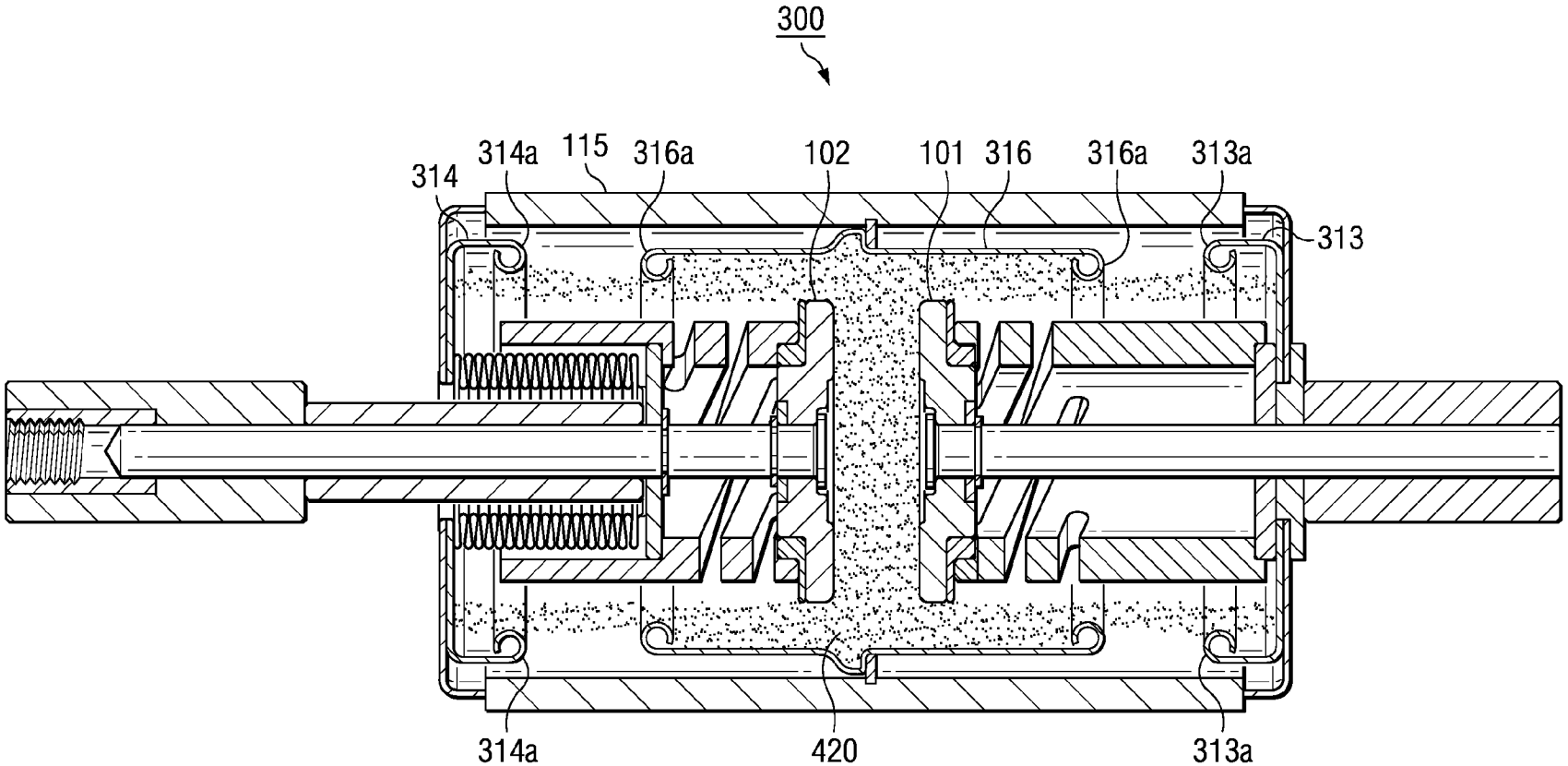
FIG. 4 is a cross-sectional side view of the exemplary vacuum fault interrupter of FIG. 3, in an open position.

FIGS. 3 and 4 are cross-sectional side views of another exemplary vacuum fault interrupter 300. Aside from certain shielding component differences, vacuum fault interrupter 300 is identical to vacuum fault interrupter 100 described previously with reference to FIGS. 1 and 2. Like reference numbers are used throughout FIGS. 1-4 to indicate features that are common between the vacuum fault interrupter 300 and the vacuum fault interrupter 100. Those like features are described in detail previously with reference to FIGS. 1-2 and, thus, are not described in detail hereinafter.

In the exemplary vacuum interrupter 300, each of the center shield 316 and the end shields 313 and 314 includes curled ends 316*a*, 313*a*, and 314*a*. The radius of curvature of the curls is significantly larger than can be machined at the tips of shields 113, 114, and 116 of the vacuum fault interrupter 100. The larger radius lowers the electrical stress at the ends of shields 313, 314, and 316, thereby increasing the voltage withstand level of the vacuum interrupter 300 relative to the voltage withstand level of vacuum interrupter 100.

The curl shape of the ends 316*a* of the center shield 316 partially shields the arc plasma 420 from passing by the ends of the center shield 316, thus protecting the ends of the center shield 316 from the heat energy of the arc plasma 420. By protecting the ends of the center shield 316 from that heat energy, the curl shape decreases the likelihood that the ends of the center shield 316 will break down or arc.

The curled ends 313*a*, 314*a*, and 316*a* of shields 313, 314, and 316 can be costly to manufacture and difficult to process and clean to the required low level of contaminants that are necessary for inclusion in a vacuum interrupter. Typically, copper and stainless steel components of a vacuum interrupter must be electropolished to achieve this required level of cleanliness. Due to their complete cup shapes, the curls at the ends 313*a*, 314*a*, and 316*a* of the shields 313, 314, and 316 can trap air, acids, or other contaminants during the electropolishing. The trapped air can cause improper cleaning of the shields 313, 314, and 316. The trapped acid or other contaminants could be carried into the subsequent assembly of the vacuum interrupter 300. In either case, the trapped air, acid, or other contaminants can cause degraded performance of the vacuum interrupter 300. This likelihood of degradation can be reduced by assembling the center shield 316 from several cleaned pieces. However, such assembly increases part count, complexity, and cost.

Figure 5:
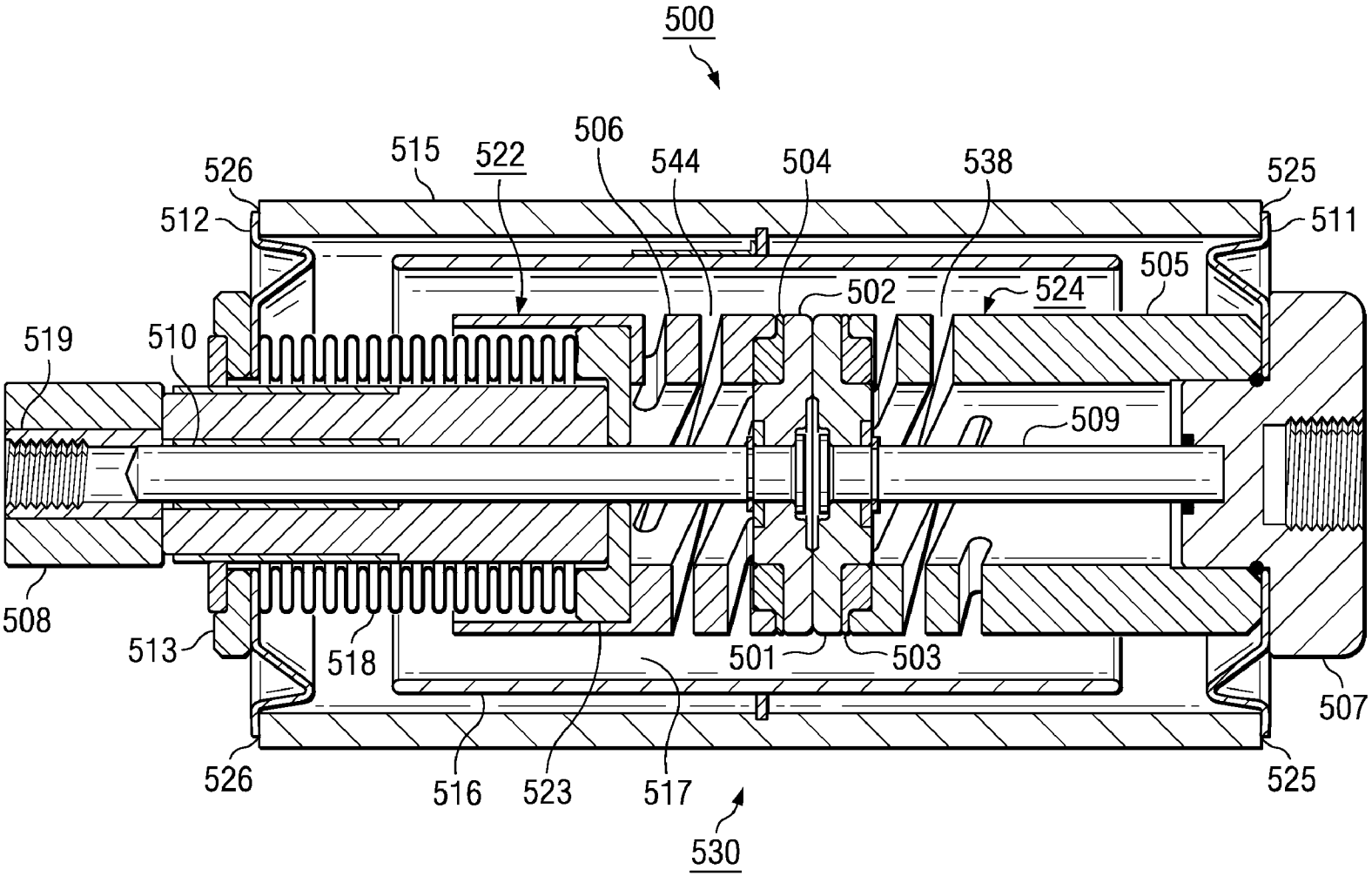
FIG. 5 is a cross-sectional side view of another exemplary vacuum fault interrupter, in a closed position.
Figure 6:
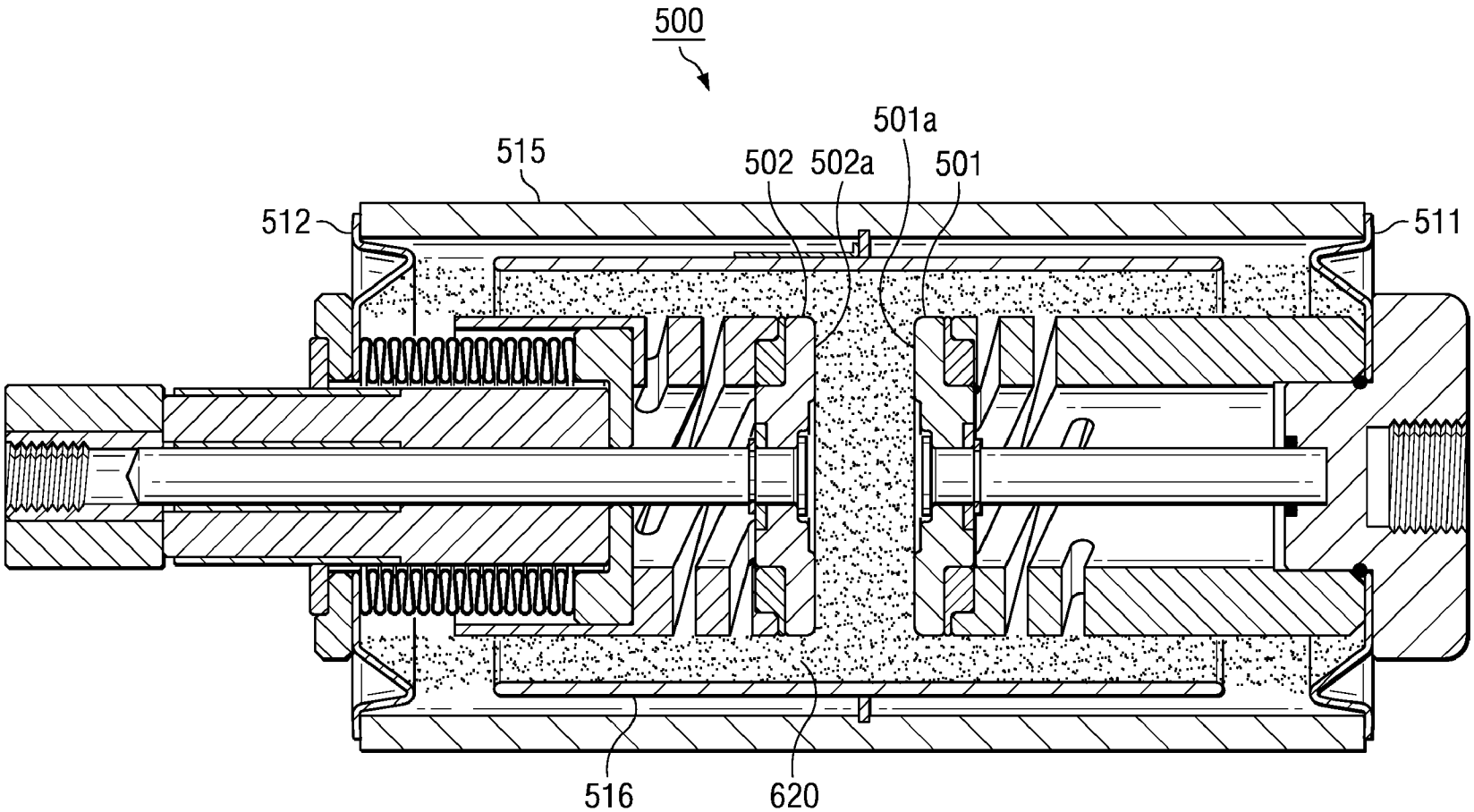
FIG. 6 is a cross-sectional side view of the exemplary vacuum fault interrupter of FIG. 5, in an open position.

FIGS. 5 and 6 are cross-sectional side views of another exemplary vacuum fault interrupter 500. Similar to the vacuum fault interrupter 100 described previously with reference to FIGS. 1 and 2, the vacuum fault interrupter 500 of FIGS. 5 and 6 includes a vacuum vessel 530 designed to maintain an integrity of a vacuum seal with respect to components enclosed therein. Air is removed from the vacuum vessel 530, leaving a deep vacuum 517, which has a high voltage withstand and desirable current interruption abilities. The vacuum vessel 530 includes an insulator 515 comprising a ceramic material and having a generally cylindrical shape. A movable electrode structure 522 within the vessel 530 is operable to move toward and away from a stationary electrode structure 524, thereby to permit or prevent a current flow through the vacuum fault interrupter 500. A bellows 518 within the vacuum vessel 530 includes a convoluted, flexible material configured to maintain the integrity of the vacuum vessel 530 during a movement of the movable electrode structure 522 toward or away from the stationary electrode structure 524. The movement of the movable electrode structure 522 toward or away from the stationary electrode structure 524 is discussed in more detail below.

The stationary electrode structure 524 includes an electrical contact 501 and a tubular coil conductor 505 in which slits 538 are machined. The electrical contact 501 and the tubular coil conductor 505 are mechanically strengthened by a structural support rod 509. For example, the tubular coil conductor 505 can include one or more pieces of copper or other suitable material, and the structural support rod 509 can include one or more pieces of stainless steel or other suitable material. An external conductive rod 507 is attached to the structural support rod 509. For example, the conductive rod 507 can include one or more pieces of copper or other suitable material. Either the structural support rod 509 or the conductive rod 507 can include one or more threads to facilitate the electrical or mechanical connections necessary to conduct current through the vacuum fault interrupter 500 or to open or close the vacuum fault interrupter 500.

The movable electrode structure 522 includes an electrical contact 502 and a tubular coil conductor 506 in which slits 544 are machined. For example, the tubular coil conductor 506 can include one or more pieces of copper or other suitable material. A conductor disc 523 is attached to the bellows 518 and the tubular coil conductor 506 such that the electrical contact 502 can be moved into and out of contact with the electrical contact 501 of the stationary electrode structure 524. Each of the electrical contacts 501 and 502 can include copper, chromium, or other suitable material. For example, each of the contacts 501 and 502 can include a composition comprising 70% copper and 30% chromium or a composition comprising 35% copper and 65% chromium.

The movable electrode structure 522 is mechanically strengthened by a structural support rod 510, which extends out of the vacuum vessel 530 and is attached to a moving rod 508. For example, the structural support rod 510 can include one or more pieces of stainless steel or other suitable material, and the moving rod 508 can include one or more pieces of copper or other suitable material. The moving rod 508 and the support rod 510 serve as a conductive external connection point between the vacuum fault interrupter 500 and an external circuit (not shown), as well as a mechanical connection point for actuation of the vacuum fault interrupter. Either the structural support rod 510 or the conductive rod 508 can include one or more threads, such as threads 519, to facilitate the electrical or mechanical connections necessary to conduct current through the vacuum fault interrupter 500 or to open or close the vacuum fault interrupter 500.

Each of the tubular coil conductors 505 and 506 of the vacuum fault interrupter 500 has a larger diameter in proportion to its respective contact diameter than the tubular coil conductors 105 and 106 of the vacuum fault interrupter 100 of FIGS. 1 and 2. For example, each of the tubular coil conductors 505 and 506 can have a diameter approximately equal to the diameter of electrical contacts 501 and 502, respectively. The larger diameters of the tubular coil conductors 505 and 506 can require the tubular coil conductors 505 and 506 to include more copper or other materials than the tubular coil conductors 105 and 106 of the vacuum fault interrupter 100 of FIGS. 1 and 2. Thus, the larger diameters can cause the tubular coil conductors 505 and 506 to cost more than the tubular coil conductors 105 and 106 of the vacuum fault interrupter 100 of FIGS. 1 and 2. Similarly, the larger diameter of the movable tubular coil conductor 506 can cause the tubular coil conductor 506 to have more mass than the movable tubular coil conductor 106, thus placing a greater burden on an actuator to open or close vacuum fault interrupter 500 at the required operating velocities than would be required for an actuator to open or close vacuum fault interrupter 100 at those same required operating velocities.

A vacuum seal at each end of the insulator 515 is provided by metal end shields 511 and 512, which are brazed to a metalized surface on the insulator 515, at joints 525-526. The end shields 511 and 512 protect the integrity of the vacuum fault interrupter 500. End shield 511 is attached between conductor disc 507 and tubular coil conductor 505. End shield 512 is positioned between the bellows 518 and a conductor disc 513. The end shields 511 and 512 are rounded and curve into the space of the vacuum vessel 530. The end shields 511 and 512 function both as end caps and end shields, substantially like the end caps 111 and 112 and the end shields 113 and 114 of the vacuum fault interrupter 100 of FIG. 1.

When the vacuum fault interrupter 500 is in a closed position, as illustrated in FIG. 5, current can flow, for example, from the tubular coil conductor 505 of the stationary electrode structure 524, the electrical contact 501 of the stationary electrode structure 524, and the electrical contact 502 of the movable electrode structure 522 to the tubular coil conductor 506 of the movable electrode structure 522, so that, with respect to contacts 501 and 502, the current can flow straight through from the ends of slits 538 and 544 in tubular coil conductor 505 and tubular coil conductor 506, respectively. The slits 538 in tubular coil conductor 505 are configured to force the current to follow a substantially circumferential path before entering the electrical contact 501. Likewise, the slits 544 in tubular coil conductor 506 are configured to force the current that exits from the electrical contact 502 to follow a substantially circumferential path before exiting the vacuum fault interrupter 500 via moving rod 508. A person of ordinary skill in the art, having the benefit of the present disclosure, will recognize that the current flow can be reversed.

A contact backing 503 is disposed between the electrical contact 501 and the tubular coil conductor 505 of the stationary electrode structure 524. Similarly, a contact backing 504 is disposed between the electrical contact 502 and the tubular coil conductor 506 of the movable electrode structure 522. Each of the contact backings 503 and 504 can include one or more pieces of copper, stainless steel, and/or other suitable material. The contact backings 503 and 504 and the slits 538 and 544 of the tubular coil conductors 505 and 506 can be used to create an axial magnetic field.

When the vacuum fault interrupter 500 is in an open position, as illustrated in FIG. 6, the electrical contacts 501 and 502 will arc until the next time the current crosses zero. The axial magnetic field generated by the contact backings 503 and 504 and the slits 538 and 544 of the tubular coil conductors 505 and 506 can control the electrical arcing between the electrical contacts 501 and 502. For example, the axial magnetic field can cause a diffuse arc between the electrical contacts 501 and 502.

The arc consists of metal vapor that is boiled off of the surface of each electrical contact 501, 502. Most of the metal vapor from each electrical contact 501, 502 deposits on the other electrical contact 501, 502. The remaining vapor disperses within the vacuum vessel 530. The primary region that can be filled with the arc plasma is easily calculable based on line of sight from the contacts 501 and 502 and is shown as item 620 in FIG. 6. A secondary region of the arc plasma, which can be identified based on reflection and bouncing of the arc plasma, can be small and will not be described in detail herein.

A centrally disposed metallic shield 516 is configured to contain the conductive arc plasma 620 and to prevent it from depositing on the surface of the insulator 515. End shields 511 and 512 are configured to contain the conductive arc plasma 620 that passes by the ends of the center shield 516. The end shields 511 and 512 can prevent the arc plasma 620 from depositing on the surface of the insulator 515 and protect the joints 525-526 at the ends of the insulator 515 from high electrical stress. Each of the shields 511, 512, and 516 can include one or more pieces of copper, stainless steel, and/or other suitable material.

The center shield 516 comprises a thicker gage material than the center shield 116 of the vacuum fault interrupter 100 of FIG. 1, allowing a larger radius to be machined at the ends of the center shield 516. That larger radius at the ends of the center shield 516 and the larger formed radius in the combined end cap/end shields 511 and 512 can lower electrical stress in the vacuum interrupter 500, resulting in increased voltage withstand performance. Similarly, the substantially equal diameters of the tubular coil conductors 505 and 506, the electrical contacts 501 and 502, and the contact backings 503 and 504 can lower electrical stress at the corners of the faces 501*a* and 502*a* of the contacts 501 and 502, as well as on the outside diameters of contacts 501 and 502 and contact backings 503 and 504, thus resulting in increased voltage withstand performance. Lowering the electrical stress on the electrical contacts 501 and 502 also can result in less arcing and contact erosion on the electrical contacts 501 and 502, leading to a longer useful product life. However, the heat of the arc plasma 620 still can cause the tips of the center shield 516 and end shields 511 and 512 to discharge or arc during fault interruption, leading to degradation of the insulator 515 due to vapor deposition.

Figure 7:
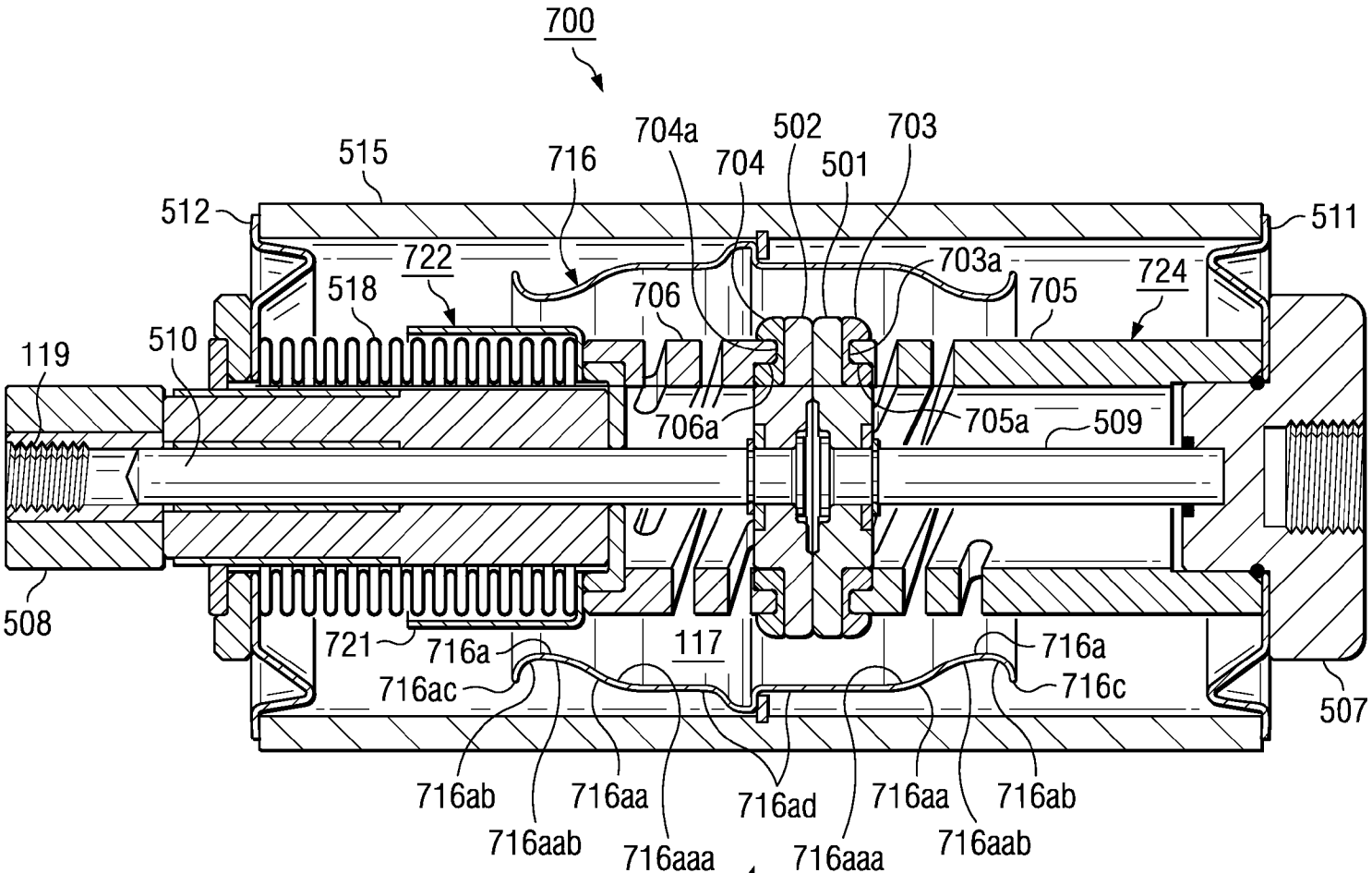
FIG. 7 is a cross-sectional side view of another exemplary vacuum fault interrupter, in a closed position.
Figure 8:
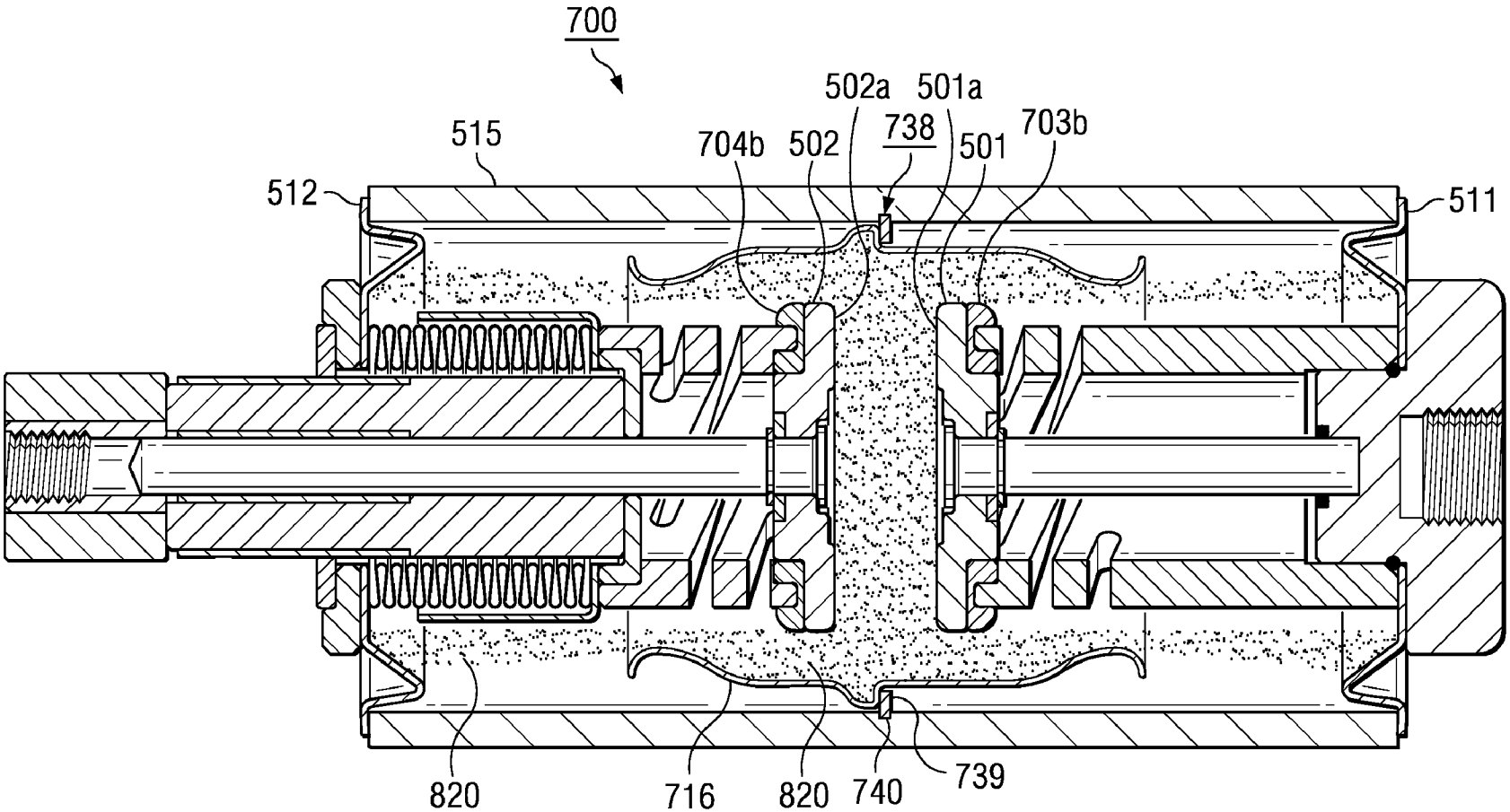
FIG. 8 is a cross-sectional side view of the exemplary vacuum fault interrupter of FIG. 7, in an open position.

FIGS. 7 and 8 are cross-sectional side views of another exemplary vacuum fault interrupter 700. Aside from certain differences in shielding, contact backing, and tubular coil components, vacuum fault interrupter 700 is identical to vacuum fault interrupter 500 described previously with reference to FIGS. 5 and 6. Like reference numbers are used throughout FIGS. 5-8 to indicate features that are common between the vacuum fault interrupter 700 and vacuum fault interrupter 500. Those like features are described in detail previously with reference to FIGS. 5 and 6 and, thus, are not described in detail hereinafter.

Each of the tubular coil conductors 705 and 706 of the vacuum fault interrupter 700 of FIGS. 7 and 8 has a smaller diameter than the tubular coil conductors 505 and 506 relative to the contact size of the vacuum fault interrupter 500 of FIGS. 5 and 6. For example, each of the tubular coil conductors 705 and 706 can have a size similar to that of the tubular coil conductors 105 and 106 of the vacuum fault interrupter 100 of FIGS. 1 and 2. The smaller diameters of the tubular coil conductors 705 and 706 can cause the tubular coil conductors 705 and 706 to cost less than the tubular coil conductors 505 and 506 of the vacuum fault interrupter 500 of FIGS. 5 and 6. Similarly, the smaller diameter of the movable tubular coil conductor 706 associated with the movable electrode assembly 722 can cause the tubular coil conductor 706 to have less mass than the movable tubular coil conductor 506, thus placing a lesser burden on an actuator to open or close vacuum fault interrupter 700 at the required operating velocities than would be required for an actuator to open or close vacuum fault interrupter 500 at those same required operating velocities.

Like the contact backings 103, 104, 503, and 504 of the vacuum fault interrupters 100, 300, and 500 of FIGS. 1-6, the contact backings 703 and 704 of the vacuum fault interrupter 700 of FIGS. 7-8 are configured to adjust the magnetic field on electrical contacts 501 and 502 of the movable electrode assembly 722 and the stationary electrode assembly 724.

The contact backings 703 and 704 also are configured to adjust electrical stress. The contact backing 703 extends perpendicular to the axis of the tubular coil conductor 705, outside the diameter of the tubular coil conductor 705, overlapping at least a portion of the tubular coil conductor 705. Similarly, the contact backing 704 extends perpendicular to the axis of the tubular coil conductor 706, outside the diameter of the tubular coil conductor 706, overlapping at least a portion of the tubular coil conductor 706. This configuration allows the corner of each contact backing 703, 704 that is disposed opposite the electrical contacts 501 and 502 to have a broad radius 703*b*, 704*b* and, thus, a low electrical stress. The configuration also can provide for a reduced electrical stress at the corners of the faces 501*a* and 502*a* of the contacts 501 and 502, as well as on the outside diameters of contacts 501 and 502 and contact backings 703 and 704, caused by the proximity of the larger axial length of the contact backings 703 and 704.

Thus, the contact backings 703 and 704 can result in a higher voltage recovery or withstand and a decrease in erosion of the electrical contacts 501 and 502. These characteristics can result in the vacuum fault interrupter 700 having a higher fault interruption current level or voltage rating than the vacuum fault interrupter 100 of FIGS. 1 and 2. For example, the higher fault interruption current level or voltage rating can be comparable to the fault interruption current level or voltage rating of the vacuum fault interrupter 500 of FIGS. 5 and 6.

The contact backings 703 and 704 can comprise one or more pieces of stainless steel or another suitable material. For example the contact backings 703 and 704 can comprise a material that provides a higher voltage withstand level than other materials, such as copper, that have been used in other vacuum fault interrupter contact backings.

The contact backing 703 includes a notch 703*a* configured to receive a corresponding protrusion 705*a* in the tubular coil conductor 705. Similarly, the contact backing 704 includes a notch 704*a* configured to receive a corresponding protrusion 706*a* in the tubular coil conductor 706. The portion of each contact backing 703, 704 disposed between the contact backing's corresponding protrusion 705*a*, 706*a* and electrical contact 501, 502 has a thickness that is sufficiently thin to minimize resistance of the electrical current from each tubular conductor 705, 706 to each electrical contact 501, 502, but is also sufficiently thick so as to alter current flow to allow adjustment to the magnetic field on electrical contacts 501 and 502.

The center shield 716 of the vacuum fault interrupter 700 has a substantially double "S" curve shape, with two flared ends 716*a*. Each end 716*a* includes a segment 716*aa* that extends inward, away from the insulator 515, and a segment 716*ab* that extends outward, towards the insulator 515. In an exemplary embodiment, the segments 716*aa* and 716*ab* create curls having radii similar to the radii of each of the curled ends 316*a* of the center shield 316 of the vacuum fault interrupter 300 of FIGS. 3 and 4, described above. In alternatively exemplary embodiments, the segments 716*aa* and 716*ab* can have different curl radii. These curls can help to reduce the electrical stress of the central shield 716.

Tip ends 716*ac* of the central shield 716 point away from sources of voltage stress, being disposed in the voltage potential and stress shadow of the remainder of the central shield 716. For example, each of the tips 716*ac* can be disposed at approximately a 90 degree angle relative to a longitudinal axis of the tubular coil conductors 705 and 706. Alternatively, the tips 716*ac* can be disposed at acute or obtuse angles relative to the longitudinal axis of the tubular coil conductors 705 and 706. The tips 716*ac* are not in the direct path of the arc plasma 820 during arcing. Thus, the tips 716*ac* are protected from the arc plasma 820, thereby reducing or eliminating break down of the tips 716*ac* due to thermal input of the arc plasma 820.

Since the curls at the ends 716*a* of the center shield 716 do not form a cup, as with the curls in the center shield 316 of the vacuum fault interrupter 300 of FIGS. 3 and 4, the center shield 716 can easily be manufactured and cleaned by known processes in the industry. The use of the center shield 716, in conjunction with the combined end caps/end shields 511 and 512 can result in lower electrical stress in the vacuum interrupter 700, resulting in a higher voltage recovery or withstand level. In certain alternative exemplary embodiments, alternative end caps and end shields, such as those described above with reference to FIGS. 1-4 can be used in place of the combined end caps/end shields 511 and 512.

Each of the shields 716, 511, and 512 can include one or more pieces of copper, stainless steel, and/or other suitable material or compositions thereof. For example, in certain exemplary embodiments, the shield 716 can include two pieces of metal joined together proximate to create a protrusion 739 on one or both of the pieces, where the protrusion 739 is configured to engage a corresponding notch 740 on the insulator 515. Alternative means for securing/aligning the shield 716 to the insulator 515, or otherwise securing/aligning the shield 716 within the vacuum vessel 730 of the vacuum field interrupter 700 are suitable. For example, the shield 716 can include a notch for receiving a corresponding protrusion of the insulator 515. For simplicity, the location at which the shield 716 and insulator 515 are coupled together is referred to herein as a "connection point" 738.

Two segments 716*ad* of the shield 716 are disposed on opposite sides of the connection point 738. The segment 716*aa* of the shield 716 is disposed between the segment 716*ad* and the segment 716*ab*. An axial distance between the segment 716*ab* and the segment 716*ad* is greater than an axial distance between the segment 716*aa* and the segment 716*ad*. A first end 716*aaa* of the segment 716*aa* is coupled to the segment 716*ad*, and a second end 716*aab* of the segment 716*aa* is coupled to the segment 716*ab*. The first end 716*aaa* of the segment 716*aa* disposed proximate to the stationary electrode assembly 724 is disposed between the contact backing 703 of the stationary electrode assembly 724 and the shield 511. The segment 716*aa* extends from the first end 716*aaa*, in a curvilinear manner, towards the shield 511. Similarly, the first end 716*aaa* of the segment 716*aa* disposed proximate to the movable electrode assembly 722 is disposed between the contact backing 704 of the movable electrode assembly 722 and extends from the first end 716*aaa*, in a curvilinear manner, towards the shield 512.

Figure 9A:
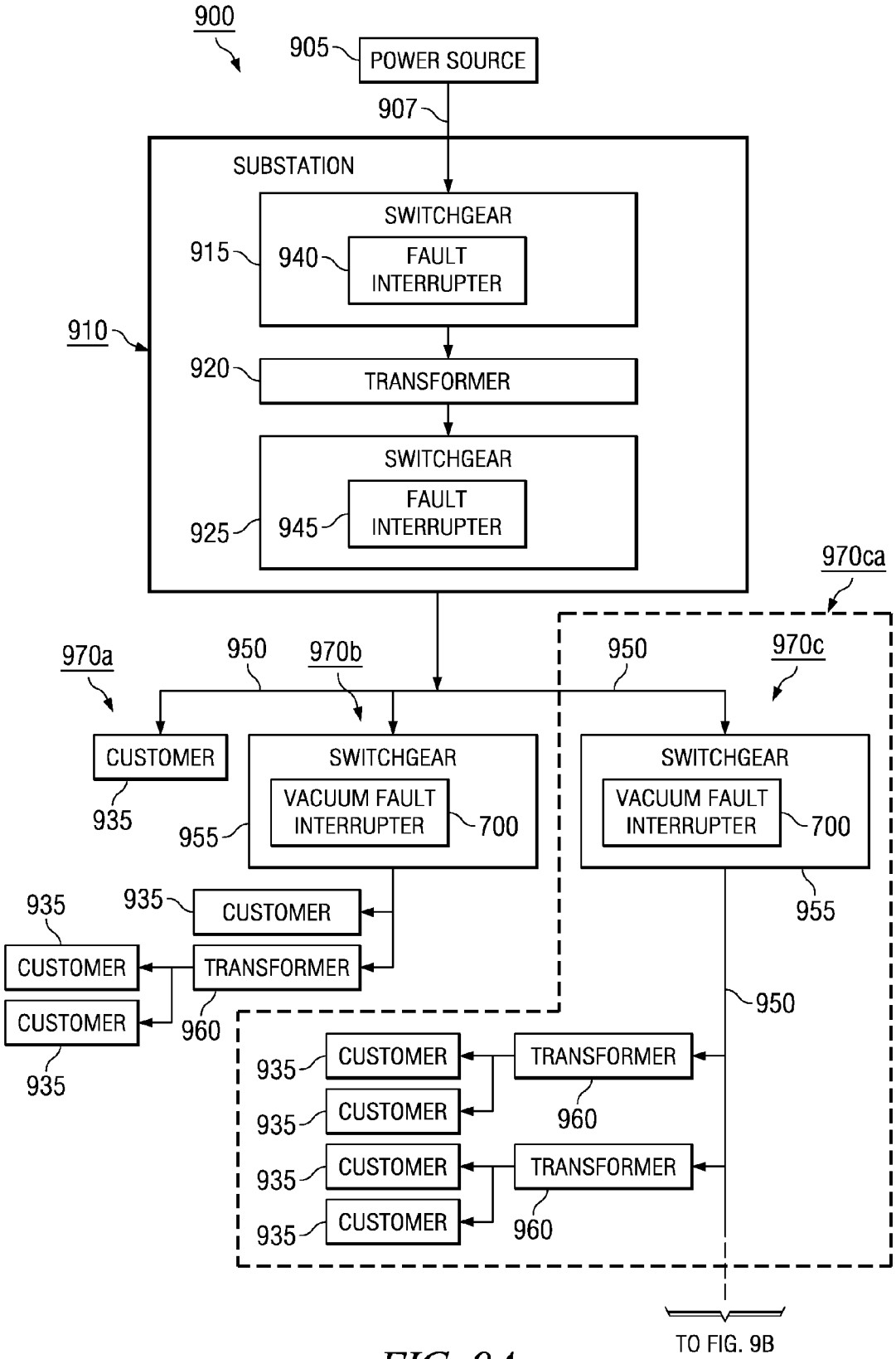
FIG. 9 is a block diagram depicting an exemplary power system using the exemplary vacuum fault interrupter of FIGS. 7 and 8.
Figure 9B:
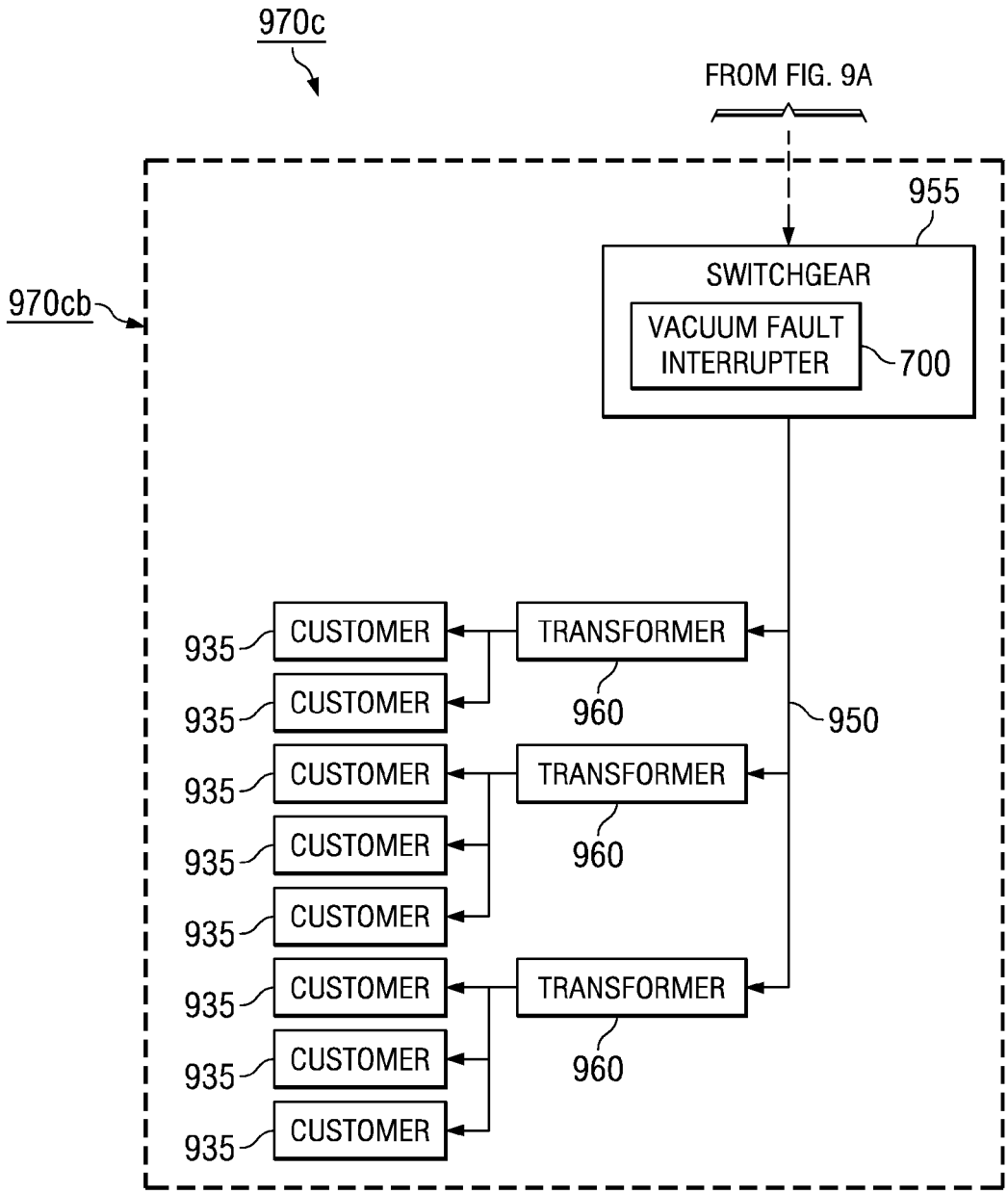

FIG. 9 is a block diagram depicting an exemplary power system 900 using the exemplary vacuum fault interrupter 700 of FIGS. 7 and 8. A power source 905, such as a high voltage transmission line leading from a power plant or another utility, transmits power to customers 935 via a substation 910, distribution power lines 950, switchgear 955, and distribution transformers 960. While the exemplary power system 900 depicted in FIG. 9 includes only one substation 910 and only one exemplary combination of distribution power lines 950, switchgear 955, distribution transformers 960, and customers 935, a person of ordinary skill in the art, having the benefit of the present disclosure, will recognize that the power system 900 can include any number of substations 910, distribution power lines 950, switchgear 955, and distribution transformers 960.

The contents of the substation 910 have been simplified for means of explanation and can include a high voltage switchgear 915 on one side of a transformer 920 and a medium (commonly called "distribution class") voltage switchgear 925 on another side of the transformer 920. The power source 905 can transmit power over high voltage cables 907 to the high voltage switchgear 915, which can transmit power to the medium voltage switchgear 925 via the transformer 920. The medium voltage switchgear 925 can transmit the power to the distribution power lines 950.

The term "high voltage" is used herein to refer to power having a voltage greater than 38 kV. The term "low voltage" is used herein to refer to power having a voltage between about 120 V and 240 V. The term "medium voltage" is used herein to refer to voltages used for distribution power lines between "high voltage" and "low voltage."

The transformer 920 transfers energy from one electrical circuit to another electrical circuit by magnetic coupling. For example, the transformer 920 can include two or more coupled windings and a magnetic core to concentrate magnetic flux. A voltage applied to one winding creates a time-varying magnetic flux in the core, which induces a voltage in the other windings. Varying the relative number of turns determines the voltage ratio between the windings, thus transforming the voltage from one circuit to another.

The distribution power lines 950 receive power from the medium voltage switchgear 925 of the substation 910 and transmit the received power to the customers 935. One substation 910 can provide power to multiple different distribution feeders 970. In a first distribution feeder 970*a*, the substation 910 transmits power directly to a customer 935 via the distribution power lines 950. In other distributions feeders 970*b* and 970*c*, the substation 910 provides power to multiple customers via the distribution power lines 950 and one or more switchgear 955 coupled thereto. For example, each switchgear 955 can include a vacuum interrupter 700 configured to isolate faults in the distribution power lines 950. The switchgear 955 can isolate the fault without interrupting power service in other, usable distribution power lines 950.

In distribution feeder 970*c*, the distribution power line 950 is divided into multiple segments 970*ca* and 970*cb*. Each segment 970*ca*, 970*cb* includes a switchgear 955 configured to isolate faults in the segment 970*ca*, 970*cb*. This configuration allows the switchgear 955 in the segment 970*cb* to isolate faults in the segment 970*cb* without interrupting power service in the other, usable segment 970*ca*.

The customers 935 can receive medium voltage power directly from the distribution power lines 950 or from a distribution transformer 960 coupled to the distribution power lines 950. The distribution transformer 960 is configured to step the medium voltage power from the distribution power lines 950 down to a low voltage, such as a house voltage of 120 V or 240 V ac. Each distribution transformer 960 can provide low voltage power to one or more customers 935.

Each of the switchgears 915, 925, and 955 includes a housing containing a fault interrupter configured to interrupt current faults within a circuit coupled to the switchgear 915, 925, 955. For example, each switchgear 955 can include a vacuum fault interrupter 700, a fuse, and/or a circuit breaker.

The exemplary system 900 illustrated in FIG. 9 is merely representative of the components for providing power to customers. Other embodiments may not have all of the components identified in FIG. 9 or may include additional components. For example, a person of ordinary skill in the art, having the benefit of the present disclosure will recognize that, although the exemplary power system 900 depicted in FIG. 9 includes three distribution feeders 970 and two segments 970*ca* and 970*cb*, the power system 900 can include any suitable number of distribution feeders 970 and segments 970*ca* and 970*cb*.

Test Data

Fault Interruption Testing:

Multiple tests have been conducted to determine the performance characteristics of certain exemplary vacuum fault interrupters having some of the mechanical and structural features described previously. The tests included evaluating the performance characteristics of the exemplary vacuum fault interrupters in synthetic test circuits and full power test circuits. In the full power test circuits, fault current and recovery voltage came from either a generator or a power system. In the synthetic test circuits, the fault current and the recovery voltage came from charged capacitor banks.

Synthetic testing is usually used in the development and testing of a new vacuum fault interrupter, as it is a more controlled test and can have more precise metering than power testing. Power testing is usually used for the final certification and testing of a completely designed device and includes tests of the vacuum fault interrupter, the actuator and mechanism that opens the vacuum fault interrupter, the insulation system associated with the vacuum fault interrupter, and the electronic control associated with the vacuum fault interrupter.

Typically, in both synthetic testing and power testing, the vacuum fault interrupter is tested for compliance with established testing standards, such as IEEE standard C37.60-2003. In particular, the vacuum fault interrupter is tested for compliance with standard fault interruption levels and required "duties" per Table 6 of C37.60-2003 and standard TRVs per Tables 10*a* and 10*b* (containing values and times for TRV for either three phase and single phase systems, respectively) from C37.60-2003, as applicable. Per IEEE C37.60-2003, a typical duty requires that the vacuum fault interrupter perform at three different fault current and voltage levels. For example, for a 38 kV three phase rating at 12.5 kA, the vacuum fault interrupter must interrupt 16 faults at 90% to 100% of the fault rating, which is 12.5 kA, with a peak TRV of 71.7 kV. It also must interrupt 56 faults at 45% to 55% of the fault rating (5.6 kA-6.9 kA), with a peak TRV of 78.1 kA, and 44 faults at 15% to 20% of the fault rating (1.9 kA-2.5 kA), with a peak TRV of 82.4 kV. The TRV level generally decreases as the fault current increases. Thus, a typical duty requires the vacuum fault interrupter to interrupt a total of 116 faults. In certain embodiments, the performance of the vacuum fault interrupter can be confirmed by performing two duties, resulting in 232 total fault interrupting operations.

The required duty for a single phase device—a device with one vacuum fault interrupter—is generally more onerous than that for a three phase device—a device with three vacuum fault interrupters. In a three phase device, any one vacuum fault interrupter can receive assistance from the other two vacuum fault interrupters. In many applications, the first two vacuum fault interrupters to open will do all the work in the three phase device. Using random open times, the duty and effort can be spread evenly to all three vacuum fault interrupters in the device. In a single phase device, the one vacuum fault interrupter must interrupt all 116 (or 232) fault interruptions on its own. Compounding the burden on the single phase vacuum fault interrupter is the fact that the required TRV levels are higher for single phase interruptions than for three phase interruptions. For example, the required 38 kV TRV levels for a single phase device are 95.2 kV, 90.2 kV, and 82.8 kV, as compared to the 82.4 kV, 78.1 kV, and 71.7 kV values for the single phase device.

The following table summarizes the performance of certain exemplary vacuum fault interrupters having mechanical structures substantially similar to vacuum fault interrupters 100 and 500, with three inch outside diameters and 1.75 inch diameter electrical contacts:

Vacuum Fault Interrupters 100 and 500: Results From Fault Interruption Testing

| | Interrupter Substantially Similar to Exemplary Interrupter: | Contact Material | Contact Backing Material | Power or Synthetic Testing | Single or Three Phase (Power Only) | Interruption Rating (kA) | Voltage Class (kV) | Peak TRV (kV)* | Total # of Faults** | # Did Not Clear Normally (Synthetic Testing Only) |
|---|---|---|---|---|---|---|---|---|---|---|
| 1 | 100 | Cu35/Cr65 | Copper | Power | Single | 8.0 kA | 27 kV | 67.6 kV | 232 | — |
| 2 | 100 | Cu35/Cr65 | Copper | Power | Three | 12.0 kA | 27 kV | 58.6 kV | 232 | — |
| 3 | 100 | Cu70/Cr30 | None | Power | Single | 12.5 kA | 27 kV | 67.6 kV | 232 | — |
| 4 | 100 | Cu70/Cr30 | None | Power | Three | 12.5 kA | 27 kV | 58.6 kV | 232 | — |
| 5 | 100 | Cu70/Cr30 | None | Power | Three | 12.5 kA | 38 kV | 82.4 kV | 232 | — |
| 6 | 500 | Cu70/Cr30 | Stain. Steel | Synthetic | — | 16.0 kA | 27 kV | 67.6 kV | 116 | 1-2 |
| 7 | 500 | Cu70/Cr30 | Stain. Steel | Synthetic | — | 12.5 kA | 38 kV | 92.2 kV | 116 | 9-13 |
| 8 | 500 | Cu70/Cr30 | Stain. Steel | Synthetic | — | 12.5 kA | 38 kV | 92.2 kV | 120*** | 20 |
| 9 | 500 | Cu70/Cr30 | Stain. Steel | Power | Single | 12.5 kA | 27 kV | 67.6 kV | 232 | — |

-continued

Vacuum Fault Interrupters 100 and 500: Results From Fault Interruption Testing

| | Interrupter Substantially Similar to Exemplary Interrupter: | Contact Material | Contact Backing Material | Power or Synthetic Testing | Single or Three Phase (Power Only) | Interruption Rating (kA) | Voltage Class (kV) | Peak TRV (kV)* | Total # of Faults** | # Did Not Clear Normally (Synthetic Testing Only) |
|---|---|---|---|---|---|---|---|---|---|---|
| 10 | 500 | Cu70/Cr30 | Stain. Steel | Power | Three | 16.0 kA | 27 kV | 58.6 kV | 232 | — |
| 11 | 500 | Cu70/Cr30 | Stain. Steel | Power | Three | 12.5 kA | 38 kV | 82.4 kV | 232 | — |

*for power tests, not all operations are at peak TRV level, depending on fault current level
**not all shots are at 90-100% fault current level, some are at 15-20% and 44-55%, per IEEE C37.60-2003
***all shots are at the 100% current level with varied levels of asymmetry for this sequence As illustrated in the above table, the exemplary vacuum fault interrupters successfully completed one or two required duties under C37.60-2003 in power testing, at either the 38 kV three phase TRV levels or the 27 kV single phase TRV levels. However, the exemplary vacuum fault interrupters did not successfully complete the testing at the 38 kV single phase TRV levels.

Examination of certain synthetic test data shows that, with higher TRV levels, the exemplary vacuum fault interrupters were much less likely to successfully clear (interrupt) the fault current after the first current zero. Examination of the exemplary vacuum fault interrupters showed that, while the degree of contact wear and erosion, as well as the amount of vapor deposition on the inside surfaces of the insulators, of the vacuum fault interrupters was acceptable for lower voltage ratings, both became excessive when the TRV levels approached that which is required for 38 kV single phase operations. In particular, the vacuum fault interrupters showed signs of arcing from the tips of the shields as well as from the contacts.

Similar tests were performed on certain exemplary vacuum fault interrupters having mechanical structures substantially similar to vacuum fault interrupter 700. The results from those tests are summarized in the following table:

per IEEE C37.60-2003. However, the results of the test can be compared with similar testing on a vacuum fault interrupter 500 discussed above in the table of results for vacuum fault interrupters 100 and 500 (number 8). While the number of unsuccessfully cleared faults on the first current zero for the vacuum fault interrupter (13-17) were reduced relative to number of unsuccessfully cleared faults on the first current zero for the vacuum fault interrupter 500 (20), there were still signs of contact wear and erosion in the vacuum fault interrupter.

The second and third vacuum fault interrupters 700 tested included electrical contacts 501 and 502 comprised of an alloy consisting of 35% copper and 65% chromium and contact backings substantially similar to the contact backings 703 and 704 of the vacuum fault interrupter 700 of FIG. 7. The second vacuum fault interrupter 700 included copper contact backings 703 and 704. The third vacuum fault interrupter 700 included stainless steel contact backings 703 and 704. These vacuum fault interrupters 700 had similar quantities of unsuccessfully cleared faults on the first current zero (12-14) to the number of unsuccessfully cleared faults on the first current zero in a vacuum fault interrupter 500 tested at the same Vacuum Fault Interrupter 700: Results From Fault Interruption Testing

| | VFI Substantially Similar to Exemplary Interrupter: | Contact Material | Contact Backing Material | Power or Synthetic Testing | Single or Three Phase (Power Only) | Interruption Rating (kA) | Voltage Class (kV) | Peak TRV (kV)* | Total # of Faults** | # Did Not Clear Normally (Synthetic Testing Only) |
|---|---|---|---|---|---|---|---|---|---|---|
| 1 | 700/100 | Cu70/Cr30 | Stain. Steel | Synthetic | — | 12.5 kA | 38 kV | 92.2 kV | 120*** | 13-17 |
| 2 | 700 | Cu35/Cr65 | Copper | Synthetic | — | 12.5 kA | 38 kV | 92.2 kV | 116 | 14 |
| 3 | 700 | Cu35/Cr65 | Stain. Steel | Synthetic | — | 12.5 kA | 38 kV | 92.2 kV | 116 | 12 |
| 4 | 700 | Cu70/Cr30 | Stain. Steel | Synthetic | — | 12.5 kA | 38 kV | 92.2 kV | 116 | 5-7 |
| 5 | 700 | Cu70/Cr30 | Stain. Steel | Power | Single | 12.5 kA | 38 kV | 95.2 kV | 232 | — |

*for power tests, not all operations are at peak TRV level, depending on fault current level
** not all shots are at 90-100% fault current level, some are at 15-20% and 44-55%, per IEEE C37.60-2003
*all shots are at the 100% current level with varied levels of asymmetry for this sequence The first vacuum fault interrupter tested had a shield substantially similar to the shield 716 of the vacuum fault interrupter 700 of FIG. 7 and contact backings substantially similar to the contact backings 103 and 104 of the vacuum fault interrupter 100 of FIG. 1. This vacuum fault interrupter was tested using shots (faults) at 100% fault current, with varied asymmetry levels, rather than with a synthetic test to a duty voltage for the same duty (9-13) as discussed above in the table of results for vacuum fault interrupters 100 and 500 (number 7**).

The fourth vacuum fault interrupter 700 included electrical contacts 501 and 502 comprised of an alloy consisting of 70% copper and 30% chromium and stainless steel contact backings substantially similar to the contact backings 703 and 704 of the vacuum fault interrupter 700 of FIG. 7. This vacuum fault interrupter 700 had a substantially reduced number of unsuccessfully cleared faults on the first current zero when being synthetically tested (5-7). Upon examination after being tested, the electrical contacts 701 and 702 showed little or no signs of wear and erosion; likewise; there was very little vapor deposition on the insulator 515, and there was little or no sign of arcing on the shields 716, 511, and 513.

A fifth vacuum fault interrupter 700 having a structure substantially identical to the fourth vacuum fault interrupter also performed well in power testing. In a 38 kV single phase test, the vacuum fault interrupter 700 successfully completed two IEEE C37.60-2003 fault interrupting duties, demonstrating the vacuum fault interrupter's ability to interrupt and withstand the high 38 kV single phase TRV levels that are associated with this duty, ie: 82.8 kV for the 90% to 100% fault level interruptions, 90.2 kV for the 45% to 55% fault level interruptions, and 95.2 kV for the 15% to 20% fault level interruptions.

the vacuum fault interrupter can fail to withstand a maximum of two, to comply with standard IEC 60060-1-1989-11.

Typically, for a 27 kV system, a vacuum fault interrupter is expected to withstand a BIL of 125 kV. Typically for a 38 kV system, a vacuum fault interrupter is expected to withstand a BIL of 150 kV. However, due to increased expectations for power systems, it is becoming increasingly common for a vacuum interrupter to be expected to withstand 170 kV.

Based on extensive testing results, the table below shows the typical range for the BIL withstand that could be expected for certain exemplary vacuum fault interrupters having structures substantially similar to vacuum fault interrupters 100, 500, and 700. Each of the interrupters had a three inch outside diameter and 1.75 inch diameter electrical contacts. In some cases, the BIL has only been tested for some conditions, resulting in some blank cells in the table. Also, in some cases, few samples have been tested, leading to smaller than the typical scatter for the distribution for the measurements.

BIL Test Results for Vacuum Fault Interrupters 100, 500, and 700

| VFI Substantially Similar to Exemplary Interrupter: | Contact Material | Contact Backing | Typical BIL, Moving End +(kV) | Typical BIL, Moving End −(kV) | Typical BIL, Stationary End +(kV) | Typical BIL, Stationary End −(kV) |
|---|---|---|---|---|---|---|
| 100 | Cu70/Cr30 | None | 140-160 | 140-160 | 140-160 | 140-160 |
| 500 | Cu70/Cr30 | Stainless Steel | 145-160 | 145-160 | 145-160 | 145-160 |
| 700/100* | Cu70/Cr30 | Stainless Steel | 145-175 | 160-170 | — | — |
| 700 | Cu35/Cr65 | Copper | 170 | 160-170 | — | — |
| 700** | Cu35/Cr65 | Stainless Steel | 150+ | 150+ | — | — |
| 700 | Cu70/Cr30 | Stainless Steel | 155-175 | 160-175 | 160-175 | 155-175 |

*Interrupter substantially similar to 700, but using stainless steel contact backing of 100

**Interrupter was not tested higher than 150 kV

Basic Impulse Level (BIL) Testing:

Multiple tests, in both fluid insulation and solid insulation, have been conducted using a BIL generator to simulate the withstand level of various designs of exemplary vacuum interrupters under various transient conditions, such as a lightning surge. The vacuum fault interrupters were tested for compliance with established testing standards, including IEEE standard C37.60-2003, especially section 6.2.1.1 thereof, entitled "Lightning impulse withstand test voltage." IEEE standard C37.60-2003 requires the interrupter to withstand (i.e., maintain a voltage without a discharge) a wave that rises to a predetermined peak in 1.2 microseconds and then decays to half that peak in 50 microseconds. The vacuum fault interrupter needs to withstand voltage in four conditions: energized on the moving end with both positive and negative voltage waves while the stationary end is grounded, and energized from the stationary end with positive and negative voltage waves while the moving end is grounded. During each condition, the interrupter must withstand three high voltage impulses. If the vacuum fault interrupter fails to withstand any of those high voltage impulses, the vacuum fault interrupter must successfully withstand nine additional voltage impulses (without any failures to withstand) to comply with the standard. Alternatively, the vacuum fault interrupter can be subjected to 15 impulse waves in each condition, of which As can be seen from these results, while vacuum interrupters that have designs that are substantially similar to exemplary vacuum interrupters 100 and 500 can be expected to have a BIL withstand of approximately 145 kV to 160 kV, vacuum interrupters that have designs that are substantially similar to exemplary vacuum interrupter 700 can be expected to have a higher BIL withstand, on the order of 160 to 175 kV.

In conclusion, the foregoing exemplary embodiments enable a vacuum fault interrupter. Many other modifications, features, and embodiments will become evident to a person of ordinary skill in the art having the benefit of the present disclosure. For example, some or all of the embodiments described herein can be adapted for usage in other types of vacuum switchgear, such as vacuum switches used for isolating sections of a distribution line, switching in and out load currents, or switching in or out capacitor banks used for controlling power quality. Many of these other vacuum products are subject to high voltage applications and long useful life requirements, for which certain of the embodiments described herein can be applied and/or adapted. It should be appreciated, therefore, that many aspects of the invention were described above by way of example only and are not intended as required or essential elements of the invention unless explicitly stated otherwise. It should also be understood that the invention is not restricted to the illustrated embodiments and that various modifications can be made within the spirit and scope of the following claims.

I claim:

1. A vacuum interrupter, comprising:

an electrode assembly comprising an electrical contact;

an insulator comprising electrically-insulating material disposed substantially around the electrode assembly; and a shield disposed between the insulator and the electrode assembly and configured to prevent arc plasma from the electrical contact of the electrode assembly from depositing on at least a portion of a surface of the insulator, the shield comprising a first segment configured to align the shield with the insulator, a second segment that extends away from the insulator, and a final segment that extends towards the insulator and comprises a tip of the shield, the final segment not extending towards the second segment, wherein an axial distance between the first segment and the final segment is greater than an axial distance between the first segment and the second segment; and wherein a line perpendicular to and extending through a longitudinal axis of the electrode assembly extends through the tip and intersects the shield in only two locations in a cross-section of the shield.

2. The vacuum interrupter of claim 1, further comprising a second electrode assembly comprising an electrical contact, the second electrode assembly being disposed on the longitudinal axis and configured to move toward and away from the other electrode assembly, along the longitudinal axis.

3. The vacuum interrupter of claim 2, wherein at least one of the electrode assemblies further comprises a contact backing and a tubular coil conductor, the contact backing being disposed substantially between the electrical contact and the tubular coil conductor and extending in an axial direction outside a diameter of the tubular coil conductor, the axial direction being substantially parallel to the longitudinal axis.

4. The vacuum interrupter of claim 1, wherein the tip is disposed at approximately a 90 degree angle relative to the longitudinal axis of the electrode assembly.

5. The vacuum interrupter of claim 1, wherein the shield comprises two second segments extending away from the insulator and two final segments extending towards the insulator, each of the final segments comprising a tip of the shield and not extending towards the second segment that is closest to the final segment.

6. The vacuum interrupter of claim 1, wherein the electrode assembly further comprises a contact backing and a tubular coil conductor, the contact backing of the electrode assembly being disposed substantially between the electrical contact and the tubular coil conductor and extending in an axial direction outside a diameter of the tubular coil conductor, the axial direction being substantially parallel to the longitudinal axis.

7. The vacuum interrupter of claim 6, wherein the contact backing is configured to reduce electrical stress of the vacuum interrupter.

8. The vacuum interrupter of claim 6, wherein the contact backing comprises stainless steel.

9. The vacuum interrupter of claim 6, wherein the contact backing comprises a notch for receiving a protrusion of the tubular coil conductor.

10. The vacuum interrupter of claim 1, wherein the vacuum interrupter is a vacuum fault interrupter.

11. The vacuum interrupter of claim 1, wherein the vacuum interrupter is a vacuum switch configured to isolate a section of a power distribution line.

12. The vacuum interrupter of claim 1, wherein the vacuum interrupter is a vacuum switch configured to switch load currents.

13. The vacuum interrupter of claim 1, wherein the vacuum interrupter is a vacuum switch configured to switch a capacitor bank.

14. The vacuum interrupter of claim 1, wherein each of the two locations comprises a continuous segment of the shield.

15. The vacuum interrupter of claim 1, wherein a tangent taken from the tip forms an angle with the longitudinal axis, the angle being less than or equal to ninety degrees.

16. A shield of a vacuum interrupter, comprising:

an elongated member comprising two portions convening at a point, each of the portions comprising a first segment configured to extend away from an insulator of a vacuum fault interrupter and a final segment disposed adjacent the first segment and configured to extend towards the insulator, the final segment of each of the portions comprising a tip of the respective portion, each final segment not extending towards the first segment of its respective portion, wherein an axial distance between the point and the final segment is greater than an axial distance between the point and the first segment, wherein the elongated member is configured to prevent arc plasma from electrical contacts of an electrode assembly of the vacuum interrupter from depositing on at least a portion of a surface of the insulator; and wherein a line perpendicular to and extending through a longitudinal axis of the electrode assembly extends through the tip and intersects the shield in only two locations in a cross-section of the shield.

17. The shield of claim 16, wherein the tip of each of the portions is disposed at approximately a 90 degree angle relative to a longitudinal axis of the shield.

18. A vacuum interrupter comprising the shield of claim 17.

19. A vacuum fault interrupter comprising the shield of claim 17.

20. The shield of claim 16, wherein each of the two locations comprises a continuous portion of the shield.

21. The shield of claim 16, wherein a tangent taken from the tip forms an angle with the longitudinal axis, the angle being less than or equal to ninety degrees.

22. A power distribution system, comprising:

a distribution power line configured to provide power to at least one customer; and a switchgear coupled to the distribution power line and configured to isolate a current fault in the distribution power line, the switchgear comprising:

a vacuum interrupter comprising:

an electrode assembly comprising an electrical contact, an insulator comprising electrically-insulating material disposed substantially about the electrode assembly, and a shield disposed between the insulator and the electrode assembly and configured to prevent arc plasma from the electrical contact of the electrode assembly from depositing on at least a portion of a surface of the insulator, the shield comprising a first segment configured to align the shield with the insulator, a second segment extending away from the insulator, and a final segment extending towards the insulator and comprising a tip of the shield, the final segment not extending towards the second segment, wherein an axial distance between the first segment and the final segment is greater than an axial distance between the first segment and the second segment, the tip not extending towards the second segment, wherein a line perpendicular to and extending through a longitudinal axis of the electrode assembly extends through the tip and intersects the shield in only two locations in a cross-section of the shield.

23. The power distribution system of claim 22, wherein the vacuum interrupter further comprises a second electrode assembly comprising an electrical contact, the second electrode assembly being disposed on the longitudinal axis and configured to move toward and away from the other electrode assembly, along the longitudinal axis.

24. The power distribution system of claim 23, wherein at least one of the electrode assemblies further comprises a contact backing and a tubular coil conductor, the contact backing being disposed substantially between the electrical contact and the tubular coil conductor and extending in an axial direction outside a diameter of the tubular coil conductor, the axial direction being substantially parallel to the longitudinal axis.

25. The power distribution system of claim 22, wherein the electrode assembly further comprises a contact backing and a tubular coil conductor, the contact backing of the electrode assembly being disposed substantially between the electrical contact and the tubular coil conductor and extending in an axial direction outside a diameter of the tubular coil conductor, the axial direction being substantially parallel to the longitudinal axis.

26. The power distribution system of claim 22, further comprising a substation configured to provide the power to the distribution power line.

27. The power distribution system of claim 22, wherein each of the two locations comprises a continuous portion of the shield.

28. The power distribution system of claim 22, wherein a tangent taken from the tip forms an angle with the longitudinal axis, the angle being less than or equal to ninety degrees.

* * * * *